US010005987B2

(12) United States Patent
Pegelow et al.

(10) Patent No.: US 10,005,987 B2
(45) Date of Patent: Jun. 26, 2018

(54) ENZYME-CONTAINING WASHING OR CLEANING COMPOSITION COMPRISING CALCIUM NITRATE

(71) Applicant: Henkel AG & Co. KGaA, Duesseldorf (DE)

(72) Inventors: Ulrich Pegelow, Dusseldorf (DE); Detlef Buisker, Essen (DE); Ines Raschke, Langenfeld (DE)

(73) Assignee: Henkel AG & Co. KGaA (DE)

( * ) Notice: Subject to any disclaimer, the term of this patent is extended or adjusted under 35 U.S.C. 154(b) by 215 days.

(21) Appl. No.: 14/333,782

(22) Filed: Jul. 17, 2014

(65) Prior Publication Data

US 2014/0329734 A1 Nov. 6, 2014

Related U.S. Application Data

(63) Continuation of application No. PCT/EP2013/051340, filed on Jan. 24, 2013.

(30) Foreign Application Priority Data

Jan. 24, 2012 (DE) ..... 10 2012 200 959

(51) Int. Cl.
*C11D 3/386* (2006.01)
*C11D 3/04* (2006.01)

(52) U.S. Cl.
CPC ..... *C11D 3/38618* (2013.01); *C11D 3/048* (2013.01); *C11D 3/386* (2013.01); *C11D 3/38663* (2013.01)

(58) Field of Classification Search
CPC .. C11D 7/38; C11D 7/54; C11D 3/395; C11D 3/048; C11D 3/386; C11D 3/38616; C11D 3/38663; C07C 179/10
USPC ..... 510/392, 393, 405
See application file for complete search history.

(56) References Cited

U.S. PATENT DOCUMENTS

| | | | | |
|---|---|---|---|---|
| 4,318,818 | A | 3/1982 | Letton et al. | |
| 4,483,781 | A * | 11/1984 | Hartman | 510/374 |
| 5,510,052 | A * | 4/1996 | McCandlish | C11D 3/042 510/108 |
| 5,880,076 | A * | 3/1999 | Vermeer | A61K 8/42 510/119 |
| 7,300,782 | B2 | 11/2007 | Breves et al. | |
| 2004/0259222 | A1 | 12/2004 | Breves et al. | |
| 2010/0152089 | A1 | 6/2010 | Wattebled et al. | |
| 2013/0079268 | A1 | 3/2013 | Eiting et al. | |

FOREIGN PATENT DOCUMENTS

| | | | |
|---|---|---|---|
| DE | 2038103 | | 2/1972 |
| EP | 0636170 | B1 | 2/1995 |
| WO | 96/41859 | A1 | 12/1996 |
| WO | 00/42144 | A1 | 7/2000 |
| WO | 00/43488 | A1 | 7/2000 |
| WO | 00/60060 | A2 | 10/2000 |
| WO | 02/08398 | | 1/2002 |
| WO | 2007/079938 | A2 | 7/2007 |

OTHER PUBLICATIONS

Calcium Nitrate Wikipedia, 2015.*
PCT International Search Report (PCT/EP2013/051340) dated Mar. 14, 2013.
Saboury, "Stability, activity and binding properties study of a-amylase upon interaction with Ca2+ and Co2+", Biologia, Bratislava, vol. 57, Suppl. 11, pp. 221-228, 2002.
Rameshkumar et al., "Optimization of Nutritional Constitute for Enhanced Alpha amylase Production Using by Solid State Fermentation Technology", International Journal of Microbiological Research, vol. 2, No, 2, pp. 143-148, 2011.

* cited by examiner

*Primary Examiner* — Gregory R Delcotto
*Assistant Examiner* — Preeti Kumar
(74) *Attorney, Agent, or Firm* — P. Scott Smith

(57) ABSTRACT

The stabilization of enzymes in washing or cleaning compositions, especially in liquid aqueous washing or cleaning compositions, is possible through the use of only small amounts of calcium nitrate.

5 Claims, No Drawings

ENZYME-CONTAINING WASHING OR CLEANING COMPOSITION COMPRISING CALCIUM NITRATE

FIELD OF THE INVENTION

The present invention generally relates to an enzyme-containing washing or cleaning agent, and more particularly relates to a liquid washing or cleaning agent, having improved enzyme stability.

BACKGROUND OF THE INVENTION

Usual washing or cleaning agents on the market contain surfactants in order to remove dirt and spots. As a rule, combinations of multiple surfactants, in particular from the group of the anionic, nonionic, cationic, and amphoteric surfactants, are used in this context. These surfactants alone are often not capable of sufficiently removing dirt and spots, so that further adjuvants are employed in modern washing or cleaning agents. Among these further adjuvants are enzymes of various kinds such as proteases, amylases, cellulases, mannanases, pectate lyases. Further classes of enzyme are known to one skilled in the art. Because of their direct cleaning action, hydrolytic enzymes in particular, such as proteases, amylases, or lipases, are a constituent of numerous textile-cleaning or dishwashing agents.

The cleaning action, critical for the end user, of the enzymes employed in washing or cleaning agents is determined not only by the enzyme structure but also to a substantial degree by how those enzymes are formulated, and by their stabilization against environmental influences.

Enzymes having washing or cleaning activity are formulated in both solid and liquid form. The group of the solid enzyme preparations includes in particular the enzyme granulates, made up of multiple ingredients, which in turn are incorporated preferably into solid washing or cleaning agents. Liquid or gel-type washing or cleaning agents, in contrast thereto, often contain liquid enzyme preparations; the latter, unlike the enzyme granulates, are much less protected from external influences.

A number of different protective actions have been proposed in order to increase the stability of such enzyme-containing liquid washing or cleaning agents. German patent application DE 20 38 103 (Henkel), for example, teaches the stabilization of enzyme-containing dishwashing agents using saccharides, while European patent EP 636 170 B1 (Procter & Gamble) discloses propylene glycol for enzyme stabilization in liquid cleaning agents.

Polyols, in particular glycerol and 1,2-propylene glycol, are described in the existing art as reversible protease inhibitors. A corresponding technical disclosure is found, for example, in international application WO 02/08398 A2 (Genencor).

The stabilization of enzymes in aqueous cleaning agents using calcium salts such as calcium formate, calcium acetate, or calcium propionate is described by U.S. Pat. No. 4,318,818 (Procter & Gamble). In aqueous systems, however, in particular in manual dishwashing agents, salts of polyvalent cations such as calcium cations often result in turbidity during storage. This negative effect is intensified upon storage at low temperatures. The possible utilization concentrations are thereby limited, so that a sufficient enzyme-stabilizing effect cannot be guaranteed.

A second group of known stabilizers is constituted by borax, boric acid, boronic acids, or salts or esters thereof. To be mentioned thereamong are principally derivatives having aromatic groups, e.g. ortho-, meta-, or para-substituted phenylboronic acids, in particular 4-formylphenylboronic acid (4-FPBA), or the salts or esters of the aforesaid compounds. The latter compounds are disclosed as enzyme stabilizers, for example, in international patent application WO 96/41859 A1 (Novo Nordisk). Boric acids and boric acid derivatives, for example, nevertheless often have the disadvantage that they form undesired byproducts with other ingredients of a composition, in particular ingredients of washing or cleaning agents, so that they are no longer available in the relevant agents for the desired cleaning purpose, or even remain behind as a contaminant on the washed material. In addition, boric acids or borates are regarded as disadvantageous in environmental terms.

The methods discovered hitherto and described in the existing art for stabilizing enzymes are not usable in every cleaning-agent formulation depending on the chemical nature of the stabilizers, and are not always sufficient in terms of their stabilizing effect.

The object of the present Application was therefore to furnish an improved stabilizing agent for enzymes as well as an enzyme-containing washing or cleaning agent having elevated enzyme stability.

It has now been found that the disadvantages of the kind described above do not occur when a special calcium compound is used.

The subject matter of the invention is therefore the use of calcium nitrate in enzyme-containing washing or cleaning agents.

A further subject of the invention is enzyme-containing washing or cleaning agents that contain calcium nitrate.

A further subject of the invention is a method for manual or automatic cleaning of hard surfaces, in particular dishes, using an agent according to the present invention.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Use of calcium nitrate in enzyme-containing washing or cleaning agents.

An enzyme-containing, in particular liquid washing or cleaning agent, characterized in that it contains calcium nitrate, preferably in the form of calcium nitrate tetrahydrate.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has been found, surprisingly, that calcium nitrate has a stabilizing effect on enzymes. Calcium nitrate is a salt that occurs anhydrously or as a hydrate. The use of calcium nitrate tetrahydrate, and enzyme-containing washing or cleaning agents that contain calcium nitrate, is/are particularly preferred. Because calcium nitrate is a hygroscopic salt that deliquesces relatively quickly under the action of air, the use of calcium nitrate, in particular of calcium nitrate tetrahydrate, in liquid and especially aqueous washing or cleaning agents is preferred. Agents according to the present invention that are present in liquid form and especially in aqueous form are accordingly preferred.

"Liquid agents" are understood in the context of the present invention as those which are flowable under normal utilization conditions, and whose viscosity can vary over a wide range. Also included among the liquid preparations are gel-type or pasty agents, which optionally can comprise additional thickening agents known from the existing art. In a further preferred embodiment of the invention the liquid agents are aqueously based, and the agents can also contain proportions of organic solvents. Corresponding organic solvents that can be employed in liquid, aqueous washing or cleaning agents are known to one skilled in the art from the literature.

It has become apparent, advantageously, that even in relatively small quantities, calcium nitrate contributes to the stabilization of enzymes. Whereas other known enzyme stabilizers are often used in quantities of up to 10 wt %, calcium nitrate results in significant enzyme stabilization even at appreciably lower concentrations.

In a preferred embodiment of the invention an agent is therefore provided which contains calcium nitrate in quantities from 0.02 wt % to less than 1 wt %. Agents that contain calcium nitrate in quantities from 0.05 wt % to 0.5 wt % are particularly preferred, with further preference from 0.1 to 0.3 wt %.

Liquid, in particular aqueous washing or cleaning agents that contain calcium nitrate, preferably in the preferred quantities indicated above, and that represent clear, transparent liquids directly after manufacture, have the additional advantage that no turbidity occurs upon storage even at low temperatures, preferably at temperatures of at most 10° C. and in particular at 0° C., over a longer storage period, in particular upon storage for 4 weeks.

An agent according to the present invention contains at least one enzyme from the group of the known enzymes usually employed in washing or cleaning agents. In a preferred embodiment of the invention an agent according to the present invention contains an amylase and/or a protease; it is particularly preferred for the agent to contain an amylase, optionally in combination with a protease. Also correspondingly preferred is the use of calcium nitrate to increase the stability of amylases, in particular in liquid and especially in aqueous washing or cleaning agents.

Terms synonymous with "amylases" can be used, for example 1,4-alpha-D-glucan glucanhydrolase or glycogenase. Amylases that can be formulated according to the present invention are preferably α-amylases. The critical factor as to whether an enzyme is an α-amylase for purposes of the invention is its ability to hydrolyze α-(1-4)-glycose bonds in the amylose of starch.

Amylases that can be formulated according to the present invention are, for example, the α-amylases from *Bacillus licheniformis*, from *Bacillus amyloliquefaciens*, or from *Bacillus stearothermophilus*, including in particular the further developments thereof improved for use in washing or cleaning agents. The enzyme from *Bacillus licheniformus* is available from the Novozymes company under the name Termamyl®, and from Danisco/Genencor under the name Purastar® ST. Further developed products of this α-amylase are available from the Novozymes company under the trade names Duramyl® and Termamyl® ultra, from Danisco/Genencor under the name Purastar® OxAm, and from Daiwa Seiko Inc., Tokyo, Japan, as Keistase®. The α-amylase from *Bacillus amyloliquefaciens* is marketed by Novozymes under the name BAN®, and derived variants of the α-amylase from *Bacillus stearothermophilus* are marketed, likewise by Novozymes, under the names BSG® and Novamyl®. Additionally to be highlighted for this purpose are the α-amylase from *Bacillus* sp. A 7-7 (DSM 12368) and the cyclodextrin-glucanotransferase (CGTase) from *Bacillus agaradherens* (DSM 9948). Fusion products of all the aforesaid molecules are likewise usable. The further developments of the α-amylase from *Aspergillus niger* and *A. oryzae*, obtainable from Novozymes under the trade names Fungamyl®, are also suitable. Further advantageously usable commercial products are, for example, Amylase-LT® and Stainzyme® or Stainzyme Ultra® or Stainzyme Plus®, the latter likewise from Novozymes. Variants of these enzymes obtainable by point mutations can also be used according to the present invention. Particularly preferred amylases are disclosed in the international patent applications WO 00/60060, WO 03/002711, WO 03/054177, and WO 07/079938, to whose disclosure reference is therefore expressly made, or whose disclosure content relevant hereto is therefore expressly incorporated into the present patent application.

α-Amylase variants of α-amylase AA560 according to SEQ ID NO. 1 are particularly suitable for use in agents according to the present invention. The following variants are particularly advantageous:

(a) α-Amylase variants that exhibit, with respect to α-amylase AA560 according to SEQ ID NO. 1, one, two, three, four, five, or six of the following sequence modifications in the count of α-amylase AA560: R118K, D183* (deletion), G184* (deletion), N195F, R320K, R458K. Particularly preferably the α-amylase variant exhibits all six of the aforesaid sequence modifications.

(b) α-Amylase variants that exhibit, with respect to α-amylase AA560 according to SEQ ID NO. 1, the following sequence modifications (in the count of α-amylase AA560):

(1) M9L/M202I,
(2) M9L/M202I/M323T,
(3) M9L/M202I/M323T/M382Y,
(4) M9L/M202I/Y295F/A339S,
(5) M9L/M202I/Y295F,
(6) M9L/M202I/A339S,
(7) M9L/M202I/Y295F/A339S,
(8) M9L/M202I/Y295F/A339S/E345R,
(9) M9L/G149A/M202I/Y295F/A339S/E345R,
(10) M9L/M202L,
(11) M9L/M202L/M323T,
(12) M9L/M202L/M323T/M382Y,
(13) M9L/M202L/Y295F/A339S,
(14) M9L/M202L/Y295F,
(15) M9L/M202L/A339S,
(16) M9L/M202L/Y295F/A339S,
(17) M9L/M202L/Y295F/A339S, E345R,
(18) M9L/G149A/M202L/Y295F/A339S/E345R,
(19) M9L/M202T,
(20) M9L/M202T/M323T,
(21) M9L/M202T/M323T/M382Y,
(22) M9L/M202T/Y295F/A339S,
(23) M9L/M202T/Y295F,
(24) M9L/M202T/A339S,
(25) M9L/M202T/Y295F/A339S,
(26) M9L/M202T/Y295F/A339S/E345R,
(27) M9L/G149A/M202T/Y295F/A339S/E345R,
(28) M9L/G149A/M202I/V214T/Y295F/N299Y/M323T/A339S/E345R,
(29) M9L/G149A/M202L/V214I/Y295F/M323T/A339S/E345R/M382Y,

(30) M9L/G149A/G182T/G186A/M202I/V214I/Y295F/N299Y/M323T/A339S,
(31) M9L/G149A/G182T/G186A/M202L/T257I/Y295F/N299Y/M323T/A339S/E345R,
(32) M9L/G149A/M202L/V214T/Y295F/N299Y/M323T/A339S/E345R,
(33) M9L/G149A/M202I/V214I/Y295F/M323T/A339S/E345R/M382Y,
(34) M9L/G149A/G182T/G186A/M202L/V214I/Y295F/N299Y/M323T/A339S,
(35) M9L/G149A/G182T/G186A/M202I/T257I/Y295F/N299Y/M323T/A339S/E345R,
(36) M9L/G149A/M202I/V214T/Y295F/N299Y/M323T/A339S/E345R/N471E,
(37) M9L/G149A/M202L/V214I/Y295F/M323T/A339S/E345R/M382Y/N471E,
(38) M9L/G149A/G182T/G186A/M202I/V214I/Y295F/N299Y/M323T/A339S/N471E,
(39) M9L/G149A/G182T/G186A/M202L/T257I/Y295F/N299Y/M323T/A339S/E345R/N471E,
(40) M202L/M105F/M208F,
(41) G133E/M202L/Q361E,
(42) G133E/M202L/R444E,
(43) M202L/Y295F,
(44) M202L/A339S,
(45) M202L/M323T,
(46) M202L/M323T/M309L,
(47) M202L/M323T/M430I,
(48) M202L/V214T/R444Y,
(49) M202L/N283D/Q361E,
(50) M202L/M382Y/K383R,
(51) M202L/K446R/N484Q,
(52) M202I/Y295F,
(53) M202I/A339S,
(54) M202I/M105F/M208F,
(55) G133E/M202I/Q361E,
(56) G133E/M202I/R444E,
(57) M202I/M323T,
(58) M202I/M323T/M309L,
(59) M202I/M323T/M430I,
(60) M202I/V214T/R444Y,
(61) M202I/N283D/Q361E,
(62) M202I/M382Y/K383R,
(63) M202I/K446R/N484Q,
(64) M202V/M105F/M208F,
(65) G133E/M202V/Q361E,
(66) G133E/M202V/R444E,
(67) M202V/M323T,
(68) M202V/M323T/M309L,
(69) M202V/M323T/M430I,
(70) M202V/M323T/M9L,
(71) M202V/V214T/R444Y,
(72) M202V/N283D/Q361E,
(73) M202V/M382Y/K383R,
(74) M202V/K446R/N484Q,
(75) M202T/M105F/M208F,
(76) G133E/M202T/Q361E,
(77) G133E/M202T/R444E,
(78) M202T/Y295F,
(79) M202T/A339S,
(80) M202T/M323T,
(81) M202T/M323T/M309L,
(82) M202T/M323T/M430I,
(83) M202T/M323T/M9L,
(84) M202T/V214T/R444Y,
(85) M202T/N283D/Q361E,
(86) M202T/A339S,
(87) M202T/Y295F
(88) M202T/N299F, Y,
(89) M202T/M382Y/K383R, or
(90) M202T/K446R/N484Q

Very particularly preferred thereamong are the following α-amylase variants:
(10) M9L/M202L,
(28) M9L/G149A/M202I/V214T/Y295F/N299Y/M323T/A339S/E345R,
(31) M9L/G149A/G182T/G186A/M202L/T257I/Y295F/N299Y/M323T/A339S/E345R,
(35) M9L/G149A/G182T/G186A/M202I/T257I/Y295F/N299Y/M323T/
(38) M9L/G149A/G182T/G186A/M202I/V214I/Y295F/N299Y/M323T/
(39) M9L/G149A/G182T/G186A/M202L/T257I/Y295F/N299Y/M323T/A339S/E345R/N471E,
(45) M202L/M323T,
(46) M202L/M323T/M309L,
(62) M202I/M382Y/K383R,
(68) M202V/M323T/M309L,
(73) M202V/M382Y/K383R
(82) M202T/M323T/M430I, or
(84) M202T/V214T/R444Y (c) α-Amylase variants according to (b) that additionally comprise all six sequence modifications recited under (a), among them very particularly preferably variant 31 having the six sequence modifications recited under (a).

The α-amylase variant recited above under (a), as well as the α-amylase variant 31 recited under (c) having the six sequence modifications recited under (a), are very particularly preferred according to the present invention.

Liquid washing or cleaning agents preferred according to the present invention contain, based on their total weight, between 0.001 and 5.0 wt %, preferably between 0.01 and 4.0 wt %, and in particular between 0.05 and 3.0 wt % amylase preparations. Liquid washing or cleaning agents that contain, based on their total weight, between 0.07 and 2.0 wt % amylase preparations are particularly preferred.

Liquid washing or cleaning agents preferred according to the present invention contain, based on their total weight, between 0.002 and 7.0 wt %, preferably between 0.02 and 6.0 wt %, and in particular between 0.1 and 5.0 wt % protease preparations. Cleaning agents that contain, based on their total weight, between 0.2 and 4.0 wt % protease preparations are particularly preferred.

For the reasons already recited above, amylases and proteases having washing or cleaning activity are as a rule furnished not in the form of the pure protein but instead in the form of stabilized preparations capable of being stored and transported. Included among these preformulated preparations are, for example, the solid preparations obtained by granulation, extrusion, or freeze-drying, or (in particular with liquid or gel-type agents) solutions of the enzymes, which advantageously are maximally concentrated, low in water, and/or have stabilizers or further adjuvants added.

Alternatively, for both the solid and the liquid administration form, the enzymes can be encapsulated, for example by spray drying or extrusion of the enzyme solution together with a (preferably natural) polymer or in the form of capsules, for example those in which the enzymes are enclosed as if in a solidified gel or in those of the core-shell type, in which an enzyme-containing core is coated with a protective layer that is impermeable to water, air, and/or chemicals. Further active agents, for example stabilizers, emulsifier agents, pigments, bleaches, or dyes, can additionally be applied in superimposed layers. Such capsules are applied using methods known per se, for example by vibratory or roll granulation or in fluidized bed processes. Advantageously, such granulates are low in dust, for example thanks to the application of polymeric film formers, and are shelf-stable as a result of the coating.

It is furthermore possible to formulate two or more enzymes together so that a single granulate exhibits multiple enzyme activities.

As is evident from the previous statements, the enzyme protein constitutes only a fraction of the total weight of usual enzyme preparations. Protease preparations and/or amylase preparations preferably employed according to the present invention contain between 0.1 and 40 wt %, preferably between 0.2 to 30 wt %, particularly preferably between 0.4 and 20 wt %, and in particular between 0.8 and 10 wt % of the enzyme protein, based in each case on the enzyme preparation.

Besides the amylase and/or protease, the agents according to the present invention can also contain one or more enzymes having washing or cleaning activity. Suitable enzymes here are, in particular, those from the class of hydrolases, such as (poly)esterases, lipases, glycosyl hydrolases, hemicellulase, included among which are, in particular, mannanases, xanthan lyases, pectin lyases (=pectinases), pectin esterases, pectate lyases, xyloglucanases (=xylanases), pullulanases, and β-glucanases; cutinases, β-glucanases, oxidases, peroxidases, mannanases, perhydrolases, oxireductases, and/or laccases. For further possible enzymes and enzyme preparations, reference is made to the relevant existing art regarding washing or cleaning agents. The weight proportion of all enzyme preparations having washing or cleaning activity in terms of the total weight of the agent according to the present invention is preferably between 0.5 and 15 wt %, preferably between 0.5 and 12 wt %, particularly preferably between 0.6 and 10 wt %, and in particular between 0.7 and 8 wt %.

In a preferred embodiment of the invention the agent according to the present invention is a cleaning agent for hard surfaces, in particular a liquid cleaning agent for hard surfaces, for example a liquid automatic dishwashing agent or a liquid manual dishwashing agent or an all-purpose cleaner. An agent that is used for manual dishwashing is particularly preferred. Besides calcium nitrate such an agent contains, advantageously in the quantities indicated above, amylase and optionally one or more further enzymes, in particular protease and/or lipase and/or mannanase and/or pectate lyase and/or cellulase. Manual dishwashing agents that contain as enzymes a combination of amylase and protease, as well as optionally further enzymes, are furnished with particular advantage. The weight proportion of all enzyme preparations having washing or cleaning activity in terms of the total weight of the manual dishwashing agent according to the present invention is preferably between 0.5 and 5 wt %, preferably between 0.7 and 3 wt %.

The agents according to the present invention usually contain surfactants as further constituents, chiefly anionic surfactants, nonionic surfactants, amphoteric surfactants, betaines, and optionally cationic surfactants. The total quantity of surfactants in the agents according to the present invention can vary over a wide range and can be, for example, 5 to 70 wt %, preferably 10 to 55 wt %, and in particular 15 to 50 wt %.

The anionic surfactants are usually employed as an alkali metal salt, alkaline earth metal salt, and/or mono-, di-, or trialkanolammonium salt, and/or also, however, in the form of their corresponding acid to be neutralized in situ with the corresponding alkali metal hydroxide, alkaline earth metal hydroxide, and/or mono-, di-, or trialkanolamine. Potassium and in particular sodium are preferred here as alkali metals, calcium and in particular magnesium as alkaline earth metals, and mono-, di-, or triethanolamine as alkanolamines. The sodium salts are particularly preferred. Even when anionic surfactants in the form of their calcium salts are employed in manual dishwashing agents, according to the present invention the agents additionally contain calcium nitrate, preferably in the quantities indicated above.

Included among the anionic surfactants preferably employed in particular in manual dishwashing agents are, above all, alkyl ether sulfates and alkylsulfonates.

Alkyl ether sulfates (fatty alcohol ether sulfates, INCI: Alkyl Ether Sulfates) are products of sulfonation reactions on alkoxylated alcohols. One skilled in the art understands "alkoxylated alcohols" in general as the reaction products of alkylene oxide, preferably ethylene oxide, with alcohols, for purposes of the present invention preferably with longer-chain alcohols, i.e. with aliphatic straight-chain or singly or multiply branched, acyclic or cyclic, saturated or mono- or polyunsaturated, preferably straight-chain, acyclic, saturated alcohols having 6 to 22, preferably 8 to 18, in particular 10 to 16 and particularly preferably 12 to 14 carbon atoms. As a rule, what results from n mol of ethylene oxide and one mol of alcohol, depending on the reaction conditions, is a complex mixture of addition products having different degrees of ethoxylation (n=1 to 30, preferably 1 to 20, in particular 1 to 10, particularly preferably 2 to 4). A further embodiment of alkoxylation consists in the use of mixtures of alkylene oxides, preferably of the mixture of ethylene oxide and propylene oxide. Very particularly preferred for purposes of the present invention are low-ethoxylated fatty alcohols having 1 to 4 ethylene oxide units (EO), in particular 1 to 2 EO, for example 2 EO, such as Na—$C_{12-14}$ fatty alcohol+2 EO sulfate.

In a preferred embodiment the agent according to the present invention, in particular a manual dishwashing agent, contains one or more alkyl ether sulfates in a quantity from 10 to 40 wt %, preferably 13 to 35 wt %, in particular 15 to 30 wt %.

The alkylsulfonates (INCI: Sulfonic Acids) usually comprise an aliphatic straight-chain or singly or multiply branched, acyclic or cyclic, saturated or mono- or polyunsaturated, preferably branched, acyclic, saturated alkyl residue having 6 to 22, preferably 9 to 20, in particular 11 to 18, and particularly preferably 14 to 17 carbon atoms.

Suitable alkylsulfonates are accordingly the saturated alkanesulfonates, unsaturated olefinsulfonates, and ethersulfonates (deriving formally from the alkoxylated alcohols on which the alkyl ether sulfates are also based) in which a distinction is made between terminal ethersulfonates (n-ethersulfonates) having a sulfonate function bound to the polyether chain, and internal ethersulfonates (i-ethersulfonates) having a sulfonate function linked to the alkyl residue. The alkanesulfonates are preferred according to the present invention, in particular alkanesulfonates having a branched, preferably secondary alkyl residue, for example the secondary alkanesulfonate sec. —Na—$C_{13-17}$ alkanesulfonate (INCI: Sodium C14-17 Alkyl Sec Sulfonate).

The agent according to the present invention, in particular a manual dishwashing agent, contains one or more secondary alkylsulfonates in a quantity usually from 1 to 15 wt %, preferably 3 to 10 wt %, in particular 4 to 8 wt %.

Further possible usable anionic surfactants are known to the skilled artisan from the relevant existing art regarding washing or cleaning agents. These include in particular aliphatic sulfates such as fatty alcohol sulfates, monoglyceride sulfates and ester sulfonates (sulfo fatty acid esters), lignin sulfonates, alkylbenzenesulfonates, fatty acid cyanamides, anionic sulfosuccinic acid surfactants, fatty acid isethionates, acylaminoalkanesulfonates (fatty acid taurides), fatty acid sarcosinates, ether carboxylic acids, and alkyl (ether) phosphates.

Further suitable anionic surfactants are also anionic gemini surfactants having a diphenyl oxide basic structure, two sulfonate groups, and an alkyl residue on one or both benzene rings, according to the formula $^{-}O_3S(C_6H_3R)O(C_6H_3R')SO_3^{-}$, in which R denotes an alkyl residue having, for example, 6, 10, 12, or 16 carbon atoms and R' denotes R or hydrogen (Dowfax® Dry Hydrotrope Powder having $C_{16}$ alkyl residue(s); INCI: Sodium Hexyldiphenyl Ether Sulfonate, Disodium Decyl Phenyl Ether Disulfonate, Disodium Lauryl Phenyl Ether Disulfonate, Disodium Cetyl Phenyl Ether Disulfonate) and fluorinated anionic surfactants, in particular perfluorinated alkylsulfonates such as ammonium-$C_{9/10}$ perfluoroalkylsulfonate (Fluorad® FC 120) and perfluorooctanesulfonic acid potassium salt (Fluorad® FC 95), the presence of fluorine compounds in the washing or cleaning agents according to the present invention being less preferred.

Particularly preferred further anionic surfactants are the anionic sulfosuccinic acid surfactants: sulfosuccinates, sulfosuccinamates, and sulfosuccinamides, in particular sulfosuccinates and sulfosuccinamates, extremely preferably sulfosuccinates. The sulfosuccinates are the salts of the mono- and diesters of sulfosuccinic acid $HOOCCH(SO_3H)CH_2COOH$, whereas the "sulfosuccinamates" are understood as the salts of the monoamides of sulfosuccinic acid, and the "sulfosuccinamides" as the salts of the diamides of sulfosuccinic acid. The salts are preferably alkali metal salts, ammonium salts, and mono-, di-, and trialkanolammonium salts, for example mono-, di-, or triethanolammonium salts, in particular lithium, sodium, potassium, or ammonium salts, particularly preferably sodium or ammonium salts, extremely preferably sodium salts.

In the sulfosuccinates, one or both carboxyl groups of the sulfosuccinic acid is/are preferably esterified with one or two identical or different unbranched or branched, saturated or unsaturated, acyclic or cyclic, optionally alkoxylated alcohols having 4 to 22, preferably 6 to 20, in particular 8 to 18, particularly preferably 10 to 16, extremely preferably 12 to 14 carbon atoms. Particularly preferred are the esters of unbranched and/or saturated and/or acyclic and/or alkoxylated alcohols, in particular unbranched, saturated fatty alcohols and/or unbranched, saturated fatty alcohols alkoxylated with ethylene oxide and/or propylene oxide, preferably with ethylene oxide, having a degree of alkoxylation from 1 to 20, preferably 1 to 15, in particular 1 to 10, particularly preferably 1 to 6, extremely preferably 1 to 4. The monoesters are preferred over the diesters in the context of the present invention. A particularly preferred sulfosuccinate is sulfosuccinic acid lauryl polyglycol ester disodium salt (Lauryl-EO-sulfosuccinate di-Na salt, INCI: Disodium Laureth Sulfosuccinate), which is commercially obtainable e.g. as Tego® Sulfosuccinate F 30 (Goldschmidt) having a sulfosuccinate content of 30 wt %.

In the sulfosuccinamates or sulfosuccinamides, one or both carboxyl groups of the sulfosuccinic acid form(s) a carboxylic acid amide, preferably with a primary or secondary amine that carries one or two identical or different, unbranched or branched, saturated or unsaturated, acyclic or cyclic, optionally alkoxylated alkyl residues having 4 to 22, preferably 6 to 20, in particular 8 to 18, particularly preferably 10 to 16, extremely preferably 12 to 14 carbon atoms. Unbranched and/or saturated and/or acyclic alkyl residues, in particular unbranched, saturated fatty alkyl residues, are particularly preferred.

In a particular embodiment the agent according to the present invention contains as anionic sulfosuccinic acid surfactants one or more sulfosuccinates, sulfosuccinamates, and/or sulfosuccinamides, preferably sulfosuccinates and/or sulfosuccinamates, in particular sulfosuccinates, in a quantity usually from 0.001 to 5 wt %, preferably 0.01 to 4 wt %, in particular 0.1 to 3 wt %, particularly preferably 0.2 to 2 wt %, extremely preferably 0.5 to 1.5 wt %, for example 1 wt %.

Included among the "amphosurfactants" (amphoteric surfactants, zwitterionic surfactants) that can be employed according to the present invention are alkylamidoalkylamines, alkyl-substituted amino acids, acylated amino acids or biosurfactants, of which the betaines are preferred in the context of the teaching of the present invention.

Suitable betaines, which are used chiefly in manual dishwashing agents, are alkyl betaines, alkylamidobetaines, imidazolinium betaines, sulfobetaines (INCI: Sultaines), and phosphobetaines, and preferably conform to formula I $$R^1—[CO—X—(CH_2)_n]_x—N^+(R^2)(R^3)—(CH_2)_m—[CH(OH)—CH_2]_y—Y^- \quad (I)$$

in which $R^1$ is a saturated or unsaturated $C_{6-22}$ alkyl residue, preferably $C_{8-18}$ alkyl residue, in particular a saturated $C_{10-16}$ alkyl residue, for example a saturated $C_{12-14}$ alkyl residue, X is NH, $NR^4$ having the $C_{1-4}$ alkyl residue $R^4$, O, or S, n is a number from 1 to 10, preferably 2 to 5, in particular 3, x is 0 or 1, preferably 1, $R^2$, $R^3$ are mutually independently a $C_{1-4}$ alkyl residue, optionally hydroxy-substituted, for example a hydroxyethyl residue, but in particular a methyl residue, m is a number from 1 to 4, in particular 1, 2, or 3, y is 0 or 1, and Y is COO, $SO_3$, $OPO(OR^5)O$ or $P(O)OR^5)O$, $R^V$ being a hydrogen atom H or a $C_{1-4}$ alkyl residue.

The alkyl betaines and alkylamidobetaines, betaines of formula I having a carboxylate group ($Y^-$=COO), are also called carbobetaines.

Preferred betaines are the alkyl betaines of formula (Ia), alkylamidobetaines of formula (Ib), sulfobetaines of formula (Ic), and amidosulfobetaines of formula (Id):

$$R^1—N^+(CH_3)_2—CH_2COO^- \quad (Ia)$$

$$R^1—CO—NH—(CH_2)_3—N^+(CH_3)_2—CH_2COO^- \quad (Ib)$$

$$R^1—N^+(CH_3)_2—CH_2CH(OH)CH_2SO_3^- \quad (Ic)$$

$$R^1—CO—NH—(CH_2)_3—N^+(CH_3)_2—CH_2CH(OH)CH_2SO_3^- \quad (Id)$$

in which $R^1$ has the same meaning as in formula I.

Particularly preferred betaines are carbobetaines, in particular the carbobetaines of formulas (Ia) and (Ib), extremely preferably the alkylamidobetaines of formula (Ib).

A preferred betaine is, for example, Cocamidopropyl Betaine (cocamidopropyl betaine).

The agent according to the present invention contains one or more betaines in a quantity usually from 1 to 15 wt %, preferably 3 to 10 wt %, in particular 4 to 8 wt %.

The surfactants a) alkyl ether sulfate, b) secondary alkanesulfonate, and c) betaine contained in the agent according to the present invention are present preferably at a ratio of a):b):c) from 5:2:1 to 3:1:1.

Alkylamidoalkylamines (INCI: Alkylamido Alkylamines) are amphoteric surfactants of formula (III)

$$R^9—CO—NR^{10}—(CH_2)_i—N(R^{11})—(CH_2CH_2O)_j—(CH_2)_k—[CH(OH)]_l—CH_2—Z—OM \quad (III)$$

in which $R^9$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue, $R^{10}$ is a hydrogen atom H or a $C_{1-4}$ alkyl residue, preferably H, i is a number from 1 to 10, preferably 2 to 5, in particular 2 or 3, $R^{11}$ is a hydrogen atom H or $CH_2COOM$ (see below for M), j is a number from 1 to 4, preferably 1 or 2, in particular 1, k is a number from 0 to 4, preferably 0 or 1, l is 0 or 1, where k=1 when 1=1, Z is CO, $SO_2$, $OPO(OR^{12})$, or $P(O)(OR^{12})$, where $R^{12}$ is a $C_{1-4}$ alkyl residue or M (see below), and M is a hydrogen, an alkali metal, an alkaline earth metal, or a protonated alkanolamine, e.g. a protonated mono-, di-, or triethanolamine.

Preferred representatives conform to formulas IIIa to IIId:

$$R^9—CO—NH—(CH_2)_2—N(R^{11})—CH_2CH_2O—CH_2—COOM \quad (IIIa)$$

$$R^9—CO—NH—(CH_2)_2—N(R^{11})—CH_2CH_2O—CH_2CH_2—COOM \quad (IIIb)$$

$$R^9—CO—NH—(CH_2)_2—N(R^{11})—CH_2CH_2O—CH_2CH(OH)CH_2—SO_3M \quad (IIIc)$$

$$R^9—CO—NH—(CH_2)_2—N(R^{11})—CH_2CH_2O—CH_2CH(OH)CH_2—OPO_3HM \quad (IIId)$$

in which $R^{11}$ and M have the same meanings as in formula (III).

Alkyl-substituted amino acids (INCI: Alkyl-Substituted Amino Acids) preferred according to the present invention are monoalkyl-substituted amino acids according to formula (IV):

$$R^{13}—NH—CH(R^{14})—(CH_2)_u—COOM' \quad (IV)$$

in which $R^{13}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue, $R^{14}$ is a hydrogen atom H or a $C_{1-4}$ alkyl residue, preferably H, u is a number from 0 to 4, preferably 0 or 1, in particular 1, and M' is a hydrogen, an alkali metal, an alkaline earth metal, or a protonated alkanolamine, e.g. a protonated mono-, di-, or triethanolamine, alkyl-substituted imino acids according to formula (V):

$$R^{15}—N—[(CH_2)_v—COOM'']_2 \quad (V)$$

in which $R^{15}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue, v is a number from 1 to 5, preferably 2 or 3, in particular 2, and M'' is a hydrogen, an alkali metal, an alkaline earth metal, or a protonated alkanolamine, e.g. a protonated mono-, di-, or triethanolamine, where M'' can have the same or two different meanings in the two carboxy groups, e.g. can be hydrogen and sodium or sodium in both cases, and mono- or dialkyl-substituted natural amino acids according to formula (VI):

$$R^{16}—N(R^{17})—CH(R^{18})—COOM''' \quad (VI)$$

in which $R^{16}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue, $R^{17}$ is a hydrogen atom or a $C_{1-4}$ alkyl residue, optionally hydroxy- or amino-substituted, e.g. a methyl, ethyl, hydroxyethyl, or aminopropyl residue, $R^{18}$ is the residue of one of the twenty natural α-amino acids $H_2NCH(R^{18})COOH$, and M''' is a hydrogen, an alkali metal, an alkaline earth metal, or a protonated alkanolamine, e.g. a protonated mono-, di-, or triethanolamine.

Particularly preferred alkyl-substituted amino acids are the aminopropionates according to formula (IVa):

$$R^{13}—NH—CH_2CH_2—COOM' \quad (IVa)$$

in which $R^{13}$ and M' have the same meanings as in formula (IV).

Acylated amino acids are amino acids, in particular the twenty natural α-amino acids, that carry on the amino nitrogen atom the acyl residue $R^{19}CO$ of a saturated or unsaturated fatty acid $R^{19}COOH$, wherein $R^{19}$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue. The acylated amino acids can also be used as the alkali metal salt, alkaline earth metal salt, or alkanolammonium salt, e.g. mono-, di-, or triethanolammonium salt. Examples of acylated amino acids are the acyl derivatives grouped together according to INCI as Amino Acids, e.g. Sodium Cocoyl Glutamate, Lauroyl Glutamic Acid, Capryloyl Glycine, or Myristoyl Methylalanine.

In a particular embodiment of the invention a combination of two or more different anionic surfactants, in particular a binary amphoteric surfactant combination, is used. The amphoteric surfactant combination preferably contains at least one betaine, in particular at least one alkylamidobetaine, particularly preferably cocamidopropyl betaine.

The amphoteric surfactant combination furthermore preferably contains at least one amphoteric surfactant from the group comprising sodium carboxyethylcocophosphoethylimidazoline (Phosphoteric® TC-6), $C_{8/10}$-amidopropyl betaine (INCI: Capryl/Capramidopropyl Betaine; Tego® Betaine 810), N-2-hydroxyethyl-N-carboxymethyl fatty acid amidoethylamine Na (Rewoteric® AMV), and N-capryl/caprinamidoethyl-N-ethyl ether propionate Na (Rewoteric® AMVSF), as well as the betaine 3-(3-cocoamidopropyl)dimethylammonium-2-hydroxypropanesulfonate (INCI: Sultaine; Rewoteric® AM CAS) and the alkylamidoalkylamine N—[N'(N''-2-hydroxyethyl-N''-carboxyethylaminoethyl)acetic acid amido]-N,N-dimethyl-N-cocammonium betaine (Rewoteric® QAM 50), in particular together with cocoamidopropyl betaine.

In a further particular embodiment the agent according to the present invention contains one or more amphoteric surfactants in a quantity of more than 8 wt %. In yet another further particular embodiment the agent according to the present invention contains one or more amphoteric surfactants in a quantity of less than 2 wt %.

The nonionic surfactants used are preferably alkoxylated, advantageously ethoxylated, in particular primary alcohols having preferably 8 to 18 carbon atoms and an average of 1 to 12 mol ethylene oxide (EO) per mol of alcohol, in which the alcohol residue can be linear or preferably methyl-branched in the 2-position or can contain mixed linear and methyl-branched residues, such as those that are usually present in oxo alcohol residues. Particularly preferred, however, are alcohol ethoxylates having linear residues made up of alcohols of natural origin having 12 to 18 carbon atoms, e.g. from coconut, palm, tallow, or oleyl alcohol, and an average of 2 to 8 EO per mol of alcohol. The preferred ethoxylated alcohols include, for example, $C_{12-14}$ alcohols with 3 EO, 4 EO, or 7 EO, $C_{9-11}$ alcohol with 7 EO, $C_{13-15}$ alcohols with 3 EO, 5, EO, 7 EO, or 8 EO, $C_{12-18}$ alcohols with 3 EO, 5 EO, or 7 EO, and mixtures thereof, such as mixtures of $C_{12-14}$ alcohol with 3 EO and $C_{12-18}$ alcohol with 7 EO. The degrees of ethoxylation indicated represent statistical averages that can correspond to an integer or a fractional number for a specific product. Preferred alcohol ethoxylates exhibit a restricted distribution of homologs (narrow range ethoxylates, NRE). In addition to these nonionic surfactants, fatty alcohols with more than 12 EO can also be used. Examples thereof are tallow fatty alcohol with 14 EO, 25 EO, 30 EO, or 40 EO. Nonionic surfactants that contain EO and PO groups together in the molecule are also usable according to the present invention. Particularly preferably, the cleaning agent for hard surfaces contains as a nonionic surfactant a $C_{12-18}$ fatty alcohol with 7 EO or a $C_{13-15}$ oxoalcohol with 7 EO.

The nonionic surfactant content in the cleaning agent is preferably 1 to 30 wt % and by preference 2 to 25 wt %, based in each case on the total cleaning agent.

These nonionic surfactants exhibit, in combination with an amine oxide, good cleaning performance on grease-stained hard surfaces, for example dishes.

Nonionic surfactants in the context of the invention are alkoxylates but also alkylphenol polyglycol ethers, end-capped polyglycol ethers, mixed ethers and hydroxy mixed ethers, and fatty acid polyglycol esters. Also suitable are block polymers of ethylene oxide and propylene oxide, as well as fatty acid alkanolamides and fatty acid polyglycol ethers. Amine oxides and sugar surfactants, in particular alkylpolyglucosides, are also important classes of nonionic surfactants according to the present invention.

The amine oxides suitable according to the present invention include alkylamine oxides, in particular alkyldimethylamine oxides, alkylamidoamine oxides, and alkoxyalkylamine oxides. Preferred amine oxides conform to formula II:

$$R^6R^7R^8N^+—O^- \quad (II)$$

$$R^6[CO—NH—(CH_2)_w]_z—N^+(R^7)(R^8)—O^- \quad (II)$$

in which $R^6$ is a saturated or unsaturated $C_{6-22}$ alkyl residue, preferably a $C_{8-18}$ alkyl residue, in particular a saturated $C_{10-16}$ alkyl residue, for example a saturated $C_{12-14}$ alkyl residue, that is incorporated into the alkylamidoamine oxides via a carbonylamidoalkylene group —CO—NH—$(CH_2)_z$— and into the alkoxyalkylamine oxides via an oxaalkylene group —O—$(CH_2)_z$— at the nitrogen atom N, z being in each case a number from 1 to 10, preferably 2 to 5, in particular 3, $R^7$, $R^8$ are mutually independently a $C_{1-4}$ alkyl residue, optionally hydroxy-substituted, for example a hydroxyethyl residue, in particular a methyl residue.

Preferred amine oxides are, for example, cocamidopropylamine oxide (Cocamidopropylamine Oxide), but also N-cocalkyl-N,N-dimethylamine oxide, N-tallowalkyl-N,N-dihydroxyethylamine oxide, myristyl/cetyl dimethylamine oxide, or lauryl dimethylamine oxide.

The amine oxide content in the cleaning agent is preferably 1 to 15 wt % and by preference 2 to 10 wt %, based in each case on the total cleaning agent.

Sugar surfactants are known surface-active compounds among which are included, for example, the sugar surfactant classes of the alkyl glucose esters, aldobionamides, gluconamides (sugar acid amides), glycerol amides, glycerol glycolipids, polyhydroxy fatty acid amide sugar surfactants (sugar amides), and alkyl polyglycosides. Sugar surfactants preferred in the context of the teaching of the present invention are alkylpolyglycosides and sugar amides as well as derivatives thereof, in particular ethers and esters thereof. The ethers are the products of the reaction of one or more, preferably one, sugar hydroxy group with a compound containing one or more hydroxy groups, for example $C_{1-22}$ alcohols or glycols such as ethylene glycol and/or propylene glycol, wherein the sugar hydroxy group can also carry polyethylene glycol residues and/or polypropylene glycol residues. The esters are the reaction products of one or more, preferably one, sugar hydroxy group with a carboxylic acid, in particular a $C_{6-22}$ fatty acid.

Particularly preferred sugar amides conform to the formula R'C(O)N(R")[Z], in which R' denotes a linear or branched, saturated or unsaturated alkyl residue, preferably a linear unsaturated alkyl residue, having 5 to 21, preferably 5 to 17, in particular 7 to 15, particularly preferably 7 to 13 carbon atoms, R" denotes a linear or branched, saturated or unsaturated alkyl residue, preferably a linear unsaturated alkyl residue, having 6 to 22, preferably 6 to 18, in particular 8 to 16, particularly preferably 8 to 14 carbon atoms, a $C_{1-5}$ alkyl residue, in particular a methyl, ethyl, propyl, isopropyl, n-butyl, isobutyl, tert-butyl, or n-pentyl residue, or hydrogen, and Z denotes a sugar residue, i.e. a monosaccharide residue. Particularly preferred sugar amides are the amides of glucose (glucamides), for example lauroyl methyl glucamide.

Alkylpolyglycosides (APGs) are particularly preferred sugar surfactants in the context of the teaching of the present invention, and preferably conform to the general formula $R^iO(AO)_a[G]_x$, in which $R^i$ denotes a linear or branched, saturated or unsaturated alkyl residue having 6 to 22, preferably 6 to 18, in particular 8 to 16, particularly preferably 8 to 14 carbon atoms, [G] denotes a glycosidally linked sugar residue, and x denotes a number from 1 to 10 and AO denotes an alkylenoxy group, e.g. an ethylenoxy or propylenoxy group, and a denotes the average degree of alkoxylation from 0 to 20. The $(AO)_a$ group can also contain different alkylenoxy units. e.g. ethylenoxy or propylenoxy units, "a" then being the average total degree of alkoxylation, i.e. the sum of the degree of ethoxylation and degree of propoxylation. Unless stated hereinafter in more detail or differently, the alkyl residues $R^i$ of the APGs are linear unsaturated residues having the indicated number of carbon atoms.

APGs are nonionic surfactants and represent known substances that can be obtained in accordance with the relevant methods of preparative organic chemistry. The index number x indicates the degree of oligomerization (DP), i.e. the distribution of mono- and oligoglycosides, and denotes a number between 1 and 10. Whereas x in a given compound must always be an integer and in this case can chiefly assume the values x=1 to 6, the value x for a specific alkylglycoside is an analytically ascertained calculated variable that usually represents a fractional number. Alkylglycosides having an average degree of oligomerization x from 1.1 to 3.0 are preferably used. From an applications-engineering viewpoint, those alkyl glycosides whose degree of oligomerization is less than 1.7, and in particular between 1.2 and 1.6, are preferred. Xylose, but in particular glucose, is used as a glycosidic sugar.

The alkyl or alkenyl residue R' can derive from primary alcohols having 8 to 18, preferably 8 to 14 carbon atoms. Typical examples are hexanol, octanol, decanol, and undecyl alcohol as well as industrial mixtures thereof, such as those obtained, for example, in the course of hydrogenation of industrial fatty acid methyl esters or in the course of hydrogenation of aldehydes from Roelen oxosynthesis.

The alkyl or alkenyl residue $R^i$ is preferably derived, however, from lauryl alcohol, myristyl alcohol, cetyl alcohol, palmoleyl alcohol, stearyl alcohol, isostearyl alcohol, or oleyl alcohol. Elaidyl alcohol, petroselinyl alcohol, arachidyl alcohol, gadoleyl alcohol, behenyl alcohol, erucyl alcohol, and industrial mixtures thereof, may furthermore be mentioned.

Preferred APGs are not alkoxylated (a=0), and conform to the formula $RO[G]_x$, in which R, as before, denotes a linear or branched, saturated or unsaturated alkyl residue having 4 to 22 carbon atoms, [G] denotes a glycosidically linked sugar residue, preferably a glucose residue, and x denotes a number from 1 to 10, preferably 1.1 to 3, in particular 1.2 to 1.6. Correspondingly preferred alkylpolyglycosides are, for example, a $C_{8-10}$ and a $C_{12-14}$ alkylpolyglucoside having a DP of 1.4 or 1.5, in particular $C_{8-10}$ alkyl-1,5-glucoside and $C_{12-14}$ alkyl-1,4-glucoside.

The agents according to the present invention can additionally contain one or more cationic surfactants (INCI: Quaternary Ammonium Compounds), usually in a quantity from 0.001 to 5 wt %, preferably 0.01 to 4 wt %, in particular 0.1 to 3 wt %, particularly preferably 0.2 to 2 wt %, extremely preferably 0.5 to 1.5 wt %, for example 1 wt %. Preferred cationic surfactants are quaternary surface-active compounds, in particular having an ammonium, sulfonium, phosphonium, iodonium, or arsonium group, which are also known as antimicrobial active agents. The use of quaternary surface-active compounds having an antimicrobial effect allows the agent to be equipped with an antimicrobial effect, or allows its antimicrobial effect that may already be present on the basis of other ingredients to be improved.

Particularly preferred cationic surfactants are the quaternary ammonium compounds (QACs, INCI: Quaternary Ammonium Compounds) according to the general formula $(R^I)(R^{II})(R^{III})(R^{IV})N^+X^-$, in which $R^I$ to $R^{IV}$ represent identical or different $C_{1-22}$ alkyl residues, $C_{7-28}$ aralkyl residues, or heterocyclic residues, two or (in the case of an aromatic attachment such as in pyridine) even three residues forming the heterocycle together with the nitrogen atom, for example a pyridinium or imidazolinium compound; and $X^-$ are halide ions, sulfate ions, hydroxide ions, or similar anions. For an optimum antimicrobial action, at least one of the residues preferably has a chain length from 8 to 18, in particular 12 to 16, carbon atoms.

QACs can be produced by the reaction of tertiary amines with alkylating agents such as methyl chloride, benzyl chloride, dimethyl sulfate, dodecyl bromide, but also ethylene oxide. The alkylation of tertiary amines having a long alkyl residue and two methyl groups is achieved particularly easily, and the quaternization of tertiary amines having two long residues and one methyl group can also be carried out using methyl chloride under mild conditions. Amines that possess three long alkyl residues or hydroxy-substituted alkyl residues have little reactivity, and are preferably quaternized using dimethyl sulfate.

Suitable QACs are benzalkonium chlorides having $C_8$ to $C_{18}$ alkyl residues, in particular $C_{12}$ to $C_{14}$ alkylbenzyldimethylammonium chloride. A particularly preferred QAC is cocopentaethyoxymethylammonium methosulfate (INCI: PEG-5 Cocomonium Methosulfate; Rewoquat® CPEM).

In order to avoid possible incompatibilities between the cationic surfactants and the anionic surfactants contained according to the present invention, a maximally anionic-surfactant-compatible cationic surfactant, and/or as little cationic surfactant as possible, is used; or in a particular embodiment of the invention, cationic surfactants are entirely omitted.

In a preferred embodiment the preferred liquid cleaning agent according to the present invention furthermore contains one or more water-soluble salts in order to lower the viscosity. These can be inorganic and/or organic salts; in a preferred embodiment the agent contains at least one inorganic salt.

Usable inorganic salts are preferably selected in this context from the group comprising colorless water-soluble halides, sulfates, sulfites, carbonates, hydrogen carbonates, nitrates, nitrites, phosphates, and/or oxides of the alkali metals, of the alkaline earth metals, of aluminum, and/or of the transition metals; ammonium salts are also usable. Halides and sulfates of the alkali metals are particularly preferred in this context; the inorganic salt is therefore preferably selected from the group comprising sodium chloride, potassium chloride, sodium sulfate, potassium sulfate, and mixtures thereof.

The organic salts usable according to the present invention are in particular colorless water-soluble alkali-metal, alkaline-earth-metal, ammonium, aluminum, and/or transition-metal salts of carboxylic acids. The salts are preferably selected from the group comprising formate, acetate, propionate, citrate, malate, tartrate, succinate, malonate, oxalate, lactate, and mixtures thereof.

In a preferred embodiment the cleaning agent according to the present invention contains 0.1 to 10 wt %, preferably 0.5 to 7 wt %, particularly preferably 0.8 to 5 wt % of at least one water-soluble salt. In a particularly preferred embodiment, exclusively inorganic salts are used in this context.

The water-soluble salt is used in particular to establish a lower viscosity in cleaning agents for hard surfaces that have a high surfactant concentration, in particular a high concentration of alkyl ether sulfate. In a method for lowering the viscosity of cleaning agents for hard surfaces containing a high level of surfactant, in particular a high level of alkyl ether sulfate, one or more water-soluble salts are accordingly added to the agents.

Advantageously, in an embodiment of the invention no builder substances that have calcium-precipitating properties are present in the agent according to the present invention. An agent that contains in particular no carbonate-containing salts is accordingly preferred. The use of soaps, however, is also handled restrictively.

Conversely, the use of other builder substances such as silicates, aluminum silicates (in particular zeolites), salts of inorganic di- and polycarboxylic acids, and mixtures of these substances, preferably water-soluble builder substances, can be advantageous.

Organic builder substances that can be present in the washing or cleaning agent are, for example, polycarboxylic acids usable in the form of their sodium salts, "polycarboxylic acids" being understood as those carboxylic acids which carry more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), methylglycinediacetic acid (MGDA) and their descendants, as well as mixtures thereof. Preferred salts are the salts of polycarboxylic acids such as citric acid, adipic acid, succinic acid, glutaric acid, tartaric acid, sugar acids, and mixtures thereof.

Polymeric polycarboxylates are also suitable as builders. These are, for example, the alkali metal salts of polyacrylic acid or of polymethacrylic acid, for example those having a relative molecular weight from 600 to 750,000 g/mol.

Suitable polymers are in particular polyacrylates, which preferably have a molecular weight from 1000 to 15,000 g/mol. From that group, the short-chain polyacrylates that have molar masses from 1000 to 10,000 g/mol, and particularly preferably from 1000 to 5000 g/mol, can in turn be preferred because of their superior solubility.

Also suitable are copolymeric polycarboxylates, in particular those of acrylic acid with methacrylic acid and of acrylic acid or methacrylic acid with maleic acid. To improve water solubility, the polymers can also contain allylsulfonic acids, such as allyloxybenzenesulfonic acid and methallylsulfonic acid, as monomers.

It is preferred, however, to use soluble builders, for example citric acid or acrylic polymers having a molar mass from 1000 to 5000 g/mol, in the liquid washing or cleaning agents.

The water content of the preferred liquid aqueous agent is usually 15 to 90 wt %, preferably 20 to 85 wt %, in particular 30 to 80 wt %. The agent according to the present invention can advantageously additionally contain one or more water-soluble organic solvents, usually in a quantity from 0.1 to 30 wt %, preferably 1 to 20 wt %, in particular 2 to 15 wt %, particularly preferably 3 to 12 wt %, extremely preferably 4 to 8 wt %.

The solvent is employed in the context of the teaching of the present invention, as necessary, in particular as a hydrotrope, viscosity regulator, and/or additional cold stabilizer. It has a solubilizing effect in particular for surfactants and electrolyte as well as perfume and dye and thus contributes to the incorporation thereof; prevents the formation of liquid crystal phases; and participates in the formation of clear products. The viscosity of the agent according to the present invention decreases with an increasing quantity of solvent. Too much solvent, however, can result in a sharp drop in viscosity.

Preferred organic solvents derive from the group of mono- or polyvalent alcohols, alkanolamines, or glycol ethers. The solvents are preferably selected from ethanol, n- or isopropanol, butanol, glycol, propanediol or butanediol, glycerol, diglycol, propyl diglycol or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, or propylene glycol propyl ether, dipropylene glycol methyl ether or dipropylene glycol ethyl ether, methoxytriglycol, ethoxytriglycol, or butoxytriglycol, 1-butoxyethoxy-2-propanol, 3-methyl-3-methoxybutanol, propylene glycol t-butyl ether, and mixtures of said solvents. The weight proportion of these organic solvents in terms of the total weight of cleaning agents according to the present invention is preferably 0.1 to 10 wt %, by preference 0.2 to 8.0 wt %, and in particular 0.5 to 5.0 wt %.

A particularly preferred organic solvent that is particularly effective in terms of stabilizing the enzymatic cleaning agents is glycerol, as well as 1,2-propylene glycol.

Suitable solvents are, for example, also saturated or unsaturated, preferably saturated, branched or unbranched $C_{1-20}$ hydrocarbons, preferably $C_{2-15}$ hydrocarbons, having at least one hydroxy group and optionally one or more ether functions C—O—C, i.e. oxygen atoms interrupting the carbon atom chain.

Preferred solvents are the $C_{2-6}$ alkylene glycols and poly-$C_{2-3}$ alkylene glycol ethers (optionally etherified at one end with a $C_{1-6}$ alkanol) having an average of 1 to 9 identical or different, preferably identical alkylene glycol groups per molecule, as well as the $C_{1-6}$ alcohols, preferably ethanol, n-propanol, or isopropanol, in particular ethanol.

Examples of solvents are the following compounds recited in accordance with INCI: Alcohol (Ethanol), Buteth-3, Butoxydiglycol, Butoxyethanol, Butoxyisopropanol, Butoxypropanol, n-Butyl Alcohol, t-Butyl Alcohol, Butylene Glycol, Butyloctanol, Diethylene Glycol, Dimethoxydiglycol, Dimethyl Ether, Dipropylene Glycol, Ethoxydiglycol, Ethoxyethanol, Ethyl Hexanediol, Glycol, Hexanediol, 1,2,6-Hexanetriol, Hexyl Alcohol, Hexylene Glycol, Isobutoxypropanol, Isopentyldiol, Isopropyl Alcohol (Isopropanol), 3-Methoxybutanol, Methoxydiglycol, Methoxyethanol, Methoxyisopropanol, Methoxymethylbutanol, Methoxy PEG-10, Methylal, Methyl Alcohol, Methyl Hexyl Ether, Methylpropanediol, Neopentyl Glycol, PEG-4, PEG-6, PEG-7, PEG-8, PEG-9, PEG-6 Methyl Ether, Pentylene Glycol, PPG-7, PPG-2-Buteth-3, PPG-2 Butyl Ether, PPG-3 Butyl Ether, PPG-2 Methyl Ether, PPG-3 Methyl Ether, PPG-2 Propyl Ether, Propanediol, Propyl Alcohol (n-Propanol), Propylene Glycol, Propylene Glycol Butyl Ether, Propylene Glycol Propyl Ether, Tetrahydrofurfuryl Alcohol, Trimethylhexanol.

Particularly preferred solvents are the poly-$C_{2-3}$ alkylene glycol ethers etherified at one end with a $C_{1-6}$ alkanol, having an average of 1 to 9, preferably 2 to 3 ethylene glycol or propylene glycol groups, for example PPG-2 Methyl Ether (dipropylene glycol monomethyl ether).

Besides the solvents previously described, alkanolamines and alkylbenzenesulfonates having 1 to 3 carbon atoms in the alkyl residue can, for example, also be used as solubilizers in particular for perfume and dyes.

The agents according to the present invention can contain further ingredients besides the components hitherto recited. These include, for example, further surfactants, additives to improve runoff behavior and drying behavior, to adjust viscosity, for stabilization, and further adjuvants and additives usual in manual dishwashing agents, for example UV stabilizers, perfume, luster agents, dyes, corrosion inhibitors, preservatives, organic salts, disinfectants, enzymes, pH adjusting agents, and additives that provide care or improve skin feel.

To further improve runoff behavior and/or drying behavior, the agent according to the present invention can contain one or more additives from the group of surfactants, polymers, and builder substances (builders), usually in a quantity from 0.001 to 5 wt %, preferably 0.01 to 4 wt %, in particular 0.1 to 3 wt %, particularly preferably 0.2 to 2 wt %, extremely preferably 0.5 to 1.5 wt %, for example 1 wt %, wherein calcium-precipitating builder substances are, as described above, very largely omitted.

Reference is made to the disclosure of WO 2011/147665 regarding further ingredients of automatic dishwashing agents, in particular liquid automatic dishwashing agents.

The preferred viscosity for the liquid agent according to the present invention, measured with a Brookfield LV DV II viscometer and spindle 31 at 20° C. and a shear rate of 30 $min^{-1}$, is in the range from 10 to 5000 mPa·s, preferably 50 to 2000 mPa·s, in particular 100 to 1000 mPa·s, particularly preferably 200 to 800 mPa·s, extremely preferably 300 to 700 mPa·s, for example 300 to 400 mPa·s. In particular when the surfactant content of the agent according to the present invention is low, the viscosity of the agent can be increased using thickening agents and/or, in particular when the surfactant content of the agent is high, can be decreased by means of the water-soluble organic salts that are contained, and by using solvents.

Polymeric thickening agents for purposes of the present invention are polycarboxylates that have a thickening effect as polyelectrolytes, preferably homo- and copolymerizates of acrylic acid, in particular acrylic acid copolymers such as acrylic acid/methacrylic acid copolymers, and polysaccharides, in particular heteropolysaccharides, as well as other usual thickening polymers.

Suitable polysaccharides or heteropolysaccharides are polysaccharide gums, for example gum arabic, agar, alginates, carrageenans and salts thereof, guar, guaran, tragacanth, gellan, ramsan, dextran or xanthan, and derivatives thereof, e.g. propoxylated guar, as well as mixtures thereof. Other polysaccharide thickeners, such as starches or cellulose derivatives, can be used alternatively but preferably in addition to a polysaccharide gum, for example starches of a wide variety of origins and starch derivatives, e.g. hydroxyethyl starch, starch phosphate esters or starch acetates, or carboxymethyl cellulose or its sodium salt, methyl, ethyl, hydroxyethyl, hydroxypropyl, hydroxypropylmethyl, or hydroxyethylmethyl cellulose, or cellulose acetate.

A preferred polymeric thickening agent is the microbial anionic heteropolysaccharide Xanthan Gum, which is produced by *Xanthomonas campestris* and some other species under aerobic conditions with a molecular weight from 2 to $15\times10^6$, and is obtainable for example from the Kelco company under the commercial name Keltrol®, for example a cream-colored powder Keltrol® T (Transparent) or as a white granulate Keltrol® RD (Readily Dispersible).

Acrylic acid polymers suitable as polymeric thickening agents are, for example, high-molecular-weight homopolymers of acrylic acid crosslinked with a polyalkenyl polyether, in particular an allyl ether of sucrose, pentaerythritol, or propylene (INCI: Carbomer), which are also referred to as carboxyvinyl polymers. Such polyacrylic acids are obtainable, inter alia, from the BFGoodrich company under the commercial name Carbopol®, e.g. Carbopol® 940 (molecular weight approx. 4,000,000), Carbopol® 941 (molecular weight approx. 1,250,000), or Carbopol® 934 (molecular weight approx. 3,000,000).

Particularly suitable polymeric thickening agents are, however, the following acrylic acid copolymers: (i) copolymers of two or more monomers from the group of acrylic acid, methacrylic acid, and simple esters thereof preferably formed with $C_{1-4}$ alkanols (INCI: Acrylates Copolymer), included among which are, for example, the copolymers of methacrylic acid, butyl acrylate, and methyl methacrylate (CAS 25035-69-2), or of butyl acrylate and methyl methacrylate (CAS 25852-37-3), and which are obtainable, for example, from the Rohm & Haas company under the trade names Aculyn® and Acusol®, e.g. the anionic nonassociative polymers Aculyn® 33 (crosslinked), Acusol® 810, and Acusol® 830 (CAS 25852-37-3); (ii) crosslinked high-molecular-weight acrylic acid copolymers, included among which are, for example, the copolymers, crosslinked with an allyl ether of sucrose or of pentaerythritol, of $C_{10-30}$ alkyl acrylates with one or more monomers from the group of acrylic acid, methacrylic acid, and simple esters thereof formed preferably with $C_{1-4}$ alkanols (INCI: Acrylates/C10-30 Alkyl Acrylate Crosspolymer), and which are obtainable e.g. from the BFGoodrich company under the trade name Carbopol®, for example the hydrophobized Carbopol® ETD2623 and Carbopol® 1382 (INCI: Acrylates/C10-30 Alkyl Acrylate Crosspolymer), and Carbopol® Aqua 30 (formerly Carbopol® EX 473).

The concentration of polymeric thickening agent is usually no more than 8 wt %, preferably between 0.1 and 7 wt %, particularly preferably between 0.5 and 6 wt %, in particular between 1 and 5 wt %, and extremely preferably between 1.5 and 4 wt %, for example between 2 and 2.5 wt %.

In a preferred embodiment of the invention, however, the agent is free of polymeric thickening agents.

In order to stabilize the agent according to the present invention especially with a high surfactant content, it is possible to add one or more dicarboxylic acids and/or salts thereof, in particular a composition made up of sodium salts of adipic, succinic, and glutaric acid, as obtainable e.g. under the commercial name Sokalan® DSC. It is employed advantageously in quantities from 0.1 to 8 wt %, preferably 0.5 to 7 wt %, in particular 1.3 to 6 wt %, and particularly preferably 2 to 4 wt %.

A change in the dicarboxylic acid (salt) content, in particular in quantities above 2 wt %, can contribute to a clear solution of the ingredients. It is likewise possible to influence the viscosity of the mixture, within certain limits, by means of this agent. This component furthermore influences the solubility of the mixture. This component is used particularly preferably with high surfactant contents, for example with surfactant contents above 30 wt %.

The use thereof can be omitted, however, so that the agent according to the present invention is preferably free of dicarboxylic acid (salts).

One or more further adjuvants and additives that are usual, in particular in manual dishwashing agents and further cleaning agents for hard surfaces, can also additionally be contained, in particular UV stabilizers, perfume, luster agents (INCI: Opacifying Agents; for example glycol distearate, e.g. Cutina® AGS of the Cognis company or mixtures containing it, e.g. Euperlane® of Cognis), dyes, corrosion inhibitors, preservatives (e.g. 2-bromo-2-nitropropane-1,3-diol (CAS 52-51-7) also referred to industrially as Bronopol, which is commercially obtainable e.g. as Myacide® BT or as Boots Bronopol BT from the Boots company), disinfectants, pH adjusting agents, and additives that provide care or improve skin feel (e.g. dermatologically effective substances such as vitamin A, vitamin B2, vitamin B12, vitamin C, vitamin E, D-panthenol, sericerin, collagen partial hydrolysate, various partial vegetable protein hydrolysates, protein hydrolysate/fatty acid condensates, liposomes, cholesterol, vegetable and animal oils such as lecithin, soy oil, etc., plant extracts such as aloe vera, azulene, witch hazel extracts, algae extracts, etc., allantoin, AHA complexes), in quantities usually no more than 5 wt %.

Agents according to the present invention can also contain elemental silver and/or a silver compound as an antibacterial component.

When benzoic acid, salicylic acid, or lactic acid are employed as pH regulators and/or buffer substances, these compounds can support or reinforce the antibacterial action of the silver and/or silver compound.

The pH of the liquid agent according to the present invention can be adjusted by means of usual pH regulators, for example acids such as mineral acids or citric acid and/or alkalis such as sodium hydroxide or potassium hydroxide, a range from 4 to 9, preferably 5 to 8.5, in particular 5.5 to 80 being preferred (in particular when skin and hand compatibility is desired). In order to adjust and/or stabilize the pH the agent according to the present invention can contain one or more buffer substances (INCI: Buffering Agents), usually in quantities from 0.001 to 5 wt %, preferably 0.005 to 3 wt %, in particular 0.01 to 2 wt %, particularly preferably 0.05 to 1 wt %, extremely preferably 0.1 to 0.5 wt %, for example 0.2 wt %. Buffering agents that at the same time are complexing agents or even chelators (INCI: Chelating Agents) are preferred. Particularly preferred buffering agents are citric acid or citrates, in particular sodium and potassium citrates, for example trisodium citrate.$2H_2O$ and tripotassium citrate.$H_2O$.

A liquid agent can furthermore contain hydrotropes. These are solubility promoters. Suitable hydrotropes are, for example, urea, butyl glycol, or aliphatic short-chain anionic or amphoteric solubilizers.

In an embodiment, the agent according to the present invention is intended to be applied, for use in the form of a foam, either directly onto the surface to be cleaned or onto a sponge, a cloth, a brush, or another, optionally moistened, cleaning adjuvant. A manually activated spray dispenser, selected in particular from the group comprising aerosol spray dispensers, spray dispensers that themselves build up pressure, pump spray dispensers, and trigger spray dispensers, in particular pump foam dispensers, such as those offered, for example, by the Airspray company, the Taplast company, the Keltec company, or also the Daiwa Can Company, is suitable in particular fashion for generating foam. Also suitable, in addition to trigger bottles, are pump spray dispensers and trigger spray dispensers having a container made of polyethylene, polypropylene, or polyethylene terephthalate. Such trigger bottles are offered, for example, by the Afa-Polytec company. The spray head is preferably equipped with a foam nozzle. In addition, the agent can also be introduced into a corresponding aerosol spray bottle with addition of a suitable propellant (e.g. n-butane, a propane-butane mixture, carbon dioxide, nitrogen, or a $CO_2/N_2$ mixture. A spray dispenser of this kind is, however, less preferred.

The agent according to the present invention can accordingly be placed on the market in the form of a product made up of the agent according to the present invention and a spray dispenser or foam dispenser, in particular a pump foam dispenser.

For manual cleaning of a hard surface the (in particular, liquid) cleaning agent according to the present invention is either applied directly, i.e. without dilution, for example by means of a sponge, onto the surface to be cleaned and then removed again with water.

Alternatively, the cleaning agent according to the present invention can first be diluted with water to concentrations from 1:1 to 1:1000, and the resulting cleaning solution is then brought into contact with the surface to be cleaned.

EXAMPLE

1. Residual Activity after Storage at 30° C.

The following manual dishwashing agents M1 (according to the present invention) V1, and V2 (comparison examples) (see Table 1: quantities indicated in wt %; the quantity and nature of the perfume, dye, and salts were identical in all formulas) were stored for 4 weeks at 30° C. The agents were clear both directly after manufacture and after storage. The color impression of the dye had not changed. The residual activity of the amylase used was then determined using the method described in M. Lever, Carbohydrate Determination with 4-hydroxybenzoic acid hydrazine (PAHBAH): Effect of Bismuth on the Reaction, Anal. Biochem., 1977, 81, pp. 21 to 27.

The results confirm the enzyme-stabilizing action of calcium nitrate as compared with non-stabilized manual dishwashing agents (V2) but also as compared with agents to which conventional known calcium stabilizers had been added (V1).

TABLE 1

| Ingredient | M1 | V1 | V2 |
|---|---|---|---|
| C14-C16 fatty alcohol ether sulfate with 2 EO | 8.8 | 8.8 | 8.8 |
| Cocamidopropyl betaine | 1.2 | 1.2 | 1.2 |
| Stainzyme ® 12L (amylase) | 0.8 | 0.8 | 0.8 |
| Calcium nitrate tetrahydrate | 0.2 | — | — |
| Calcium chloride | — | 0.2 | — |
| Perfume | 0.2 | 0.2 | 0.2 |
| Dye | 0.01 | 0.01 | 0.01 |
| Salts | 2.0 | 2.0 | 2.0 |
| Water | to 100 | to 100 | to 100 |
| pH* | 8.0 | 8.0 | 8.0 |
| Residual activity | 45% | trace only | not detectable |

*Measurement conditions: undiluted, measured at 20° C.; adjusted with sodium hydroxide and citric acid, respectively.

2. Shelf Stability at Low Temperatures

The storage experiments were repeated at 0° C., and the turbidity behavior was visually checked after the products M1 and V1 (clear after being manufactured) had been stored for 4 weeks. The following results were obtained:

TABLE 2

| Agent | Appearance before storage at 0° C. | Appearance after 4 weeks storage at 0° C. |
|---|---|---|
| M1 | clear | no turbidity, no flocculation |
| V1 | clear | flocculation |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

SEQUENCE LISTING

<160> NUMBER OF SEQ ID NOS: 1

<210> SEQ ID NO 1
<211> LENGTH: 485
<212> TYPE: PRT
<213> ORGANISM: Bacillus sp.

<400> SEQUENCE: 1

His His Asn Gly Thr Asn Gly Thr Met Met Gln Tyr Phe Glu Trp Tyr
1 5 10 15

Leu Pro Asn Asp Gly Asn His Trp Asn Arg Leu Arg Ser Asp Ala Ser
20 25 30

Asn Leu Lys Asp Lys Gly Ile Ser Ala Val Trp Ile Pro Pro Ala Trp
35 40 45

Lys Gly Ala Ser Gln Asn Asp Val Gly Tyr Gly Ala Tyr Asp Leu Tyr
50 55 60

Asp Leu Gly Glu Phe Asn Gln Lys Gly Thr Ile Arg Thr Lys Tyr Gly
65 70 75 80

Thr Arg Asn Gln Leu Gln Ala Ala Val Asn Ala Leu Lys Ser Asn Gly
85 90 95

Ile Gln Val Tyr Gly Asp Val Val Met Asn His Lys Gly Gly Ala Asp
100 105 110

Ala Thr Glu Met Val Arg Ala Val Glu Val Asn Pro Asn Asn Arg Asn
115 120 125

Gln Glu Val Ser Gly Glu Tyr Thr Ile Glu Ala Trp Thr Lys Phe Asp
130 135 140

Phe Pro Gly Arg Gly Asn Thr His Ser Asn Phe Lys Trp Arg Trp Tyr
145 150 155 160

His Phe Asp Gly Val Asp Trp Asp Gln Ser Arg Lys Leu Asn Asn Arg
165 170 175

Ile Tyr Lys Phe Arg Gly Asp Gly Lys Gly Trp Asp Trp Glu Val Asp
180 185 190

Thr Glu Asn Gly Asn Tyr Asp Tyr Leu Met Tyr Ala Asp Ile Asp Met
195 200 205

Asp His Pro Glu Val Val Asn Glu Leu Arg Asn Trp Gly Val Trp Tyr
210 215 220

Thr Asn Thr Leu Gly Leu Asp Gly Phe Arg Ile Asp Ala Val Lys His
225 230 235 240

Ile Lys Tyr Ser Phe Thr Arg Asp Trp Ile Asn His Val Arg Ser Ala
245 250 255

Thr Gly Lys Asn Met Phe Ala Val Ala Glu Phe Trp Lys Asn Asp Leu
260 265 270

Gly Ala Ile Glu Asn Tyr Leu Asn Lys Thr Asn Trp Asn His Ser Val
275 280 285

Phe Asp Val Pro Leu His Tyr Asn Leu Tyr Asn Ala Ser Lys Ser Gly
290 295 300

Gly Asn Tyr Asp Met Arg Gln Ile Phe Asn Gly Thr Val Val Gln Arg
305 310 315 320

His Pro Met His Ala Val Thr Phe Val Asp Asn His Asp Ser Gln Pro
325 330 335

Glu Glu Ala Leu Glu Ser Phe Val Glu Glu Trp Phe Lys Pro Leu Ala
340 345 350

Tyr Ala Leu Thr Leu Thr Arg Glu Gln Gly Tyr Pro Ser Val Phe Tyr
355 360 365

-continued

```
Gly Asp Tyr Tyr Gly Ile Pro Thr His Gly Val Pro Ala Met Lys Ser
    370                 375                 380

Lys Ile Asp Pro Ile Leu Glu Ala Arg Gln Lys Tyr Ala Tyr Gly Arg
385                 390                 395                 400

Gln Asn Asp Tyr Leu Asp His His Asn Ile Ile Gly Trp Thr Arg Glu
                405                 410                 415

Gly Asn Thr Ala His Pro Asn Ser Gly Leu Ala Thr Ile Met Ser Asp
            420                 425                 430

Gly Ala Gly Gly Asn Lys Trp Met Phe Val Gly Arg Asn Lys Ala Gly
        435                 440                 445

Gln Val Trp Thr Asp Ile Thr Gly Asn Arg Ala Gly Thr Val Thr Ile
    450                 455                 460

Asn Ala Asp Gly Trp Gly Asn Phe Ser Val Asn Gly Gly Ser Val Ser
465                 470                 475                 480

Ile Trp Val Asn Lys
                485
```

What is claimed is:

1. An enzyme-containing cleaning agent, comprising 0.07 wt % and 2.0 wt % of at least one amylase enzyme; wherein the total weight proportion of all enzymes in the cleaning agent is between 0.7 wt % and 3 wt %; and about 10 wt % of an alkyl ether sulfate having 14-16 carbon atoms having 1-4 ethylene oxide units; and 1 wt % to 8 wt % of cocoamidopropyl betaine; wherein the total quantity of surfactants in the cleaning agent is from 5 wt % to 50 wt %; and 0.1 wt % to 0.3 wt % of calcium nitrate tetrahydrate;

and wherein the cleaning agent comprises no carbonate-containing salts and wherein after being stored at 30° C. for a period of 4 weeks the cleaning agent has a residual enzyme activity of at least 45%.

2. The cleaning agent according to claim 1, wherein the cleaning agent is a liquid.

3. The cleaning agent according to claim 1, wherein when stored at 0° C. for 4 weeks the cleaning agent has no turbidity.

4. The cleaning agent according to claim 1, wherein when stored at 0° C. for 4 weeks the cleaning agent has no flocculation.

5. A method for cleaning hard surfaces, comprising, contacting a surface with a cleaning agent according to claim 1.

* * * * *